US007872215B2

(12) United States Patent
Blackburn

(10) Patent No.: US 7,872,215 B2
(45) Date of Patent: Jan. 18, 2011

(54) METHODS AND APPARATUS FOR GUIDING A PROJECTILE

(75) Inventor: Thomas R. Blackburn, Tuscon, AZ (US)

(73) Assignee: Raytheon Company, Waltham, MA (US)

( * ) Notice: Subject to any disclaimer, the term of this patent is extended or adjusted under 35 U.S.C. 154(b) by 553 days.

(21) Appl. No.: 12/039,912

(22) Filed: Feb. 29, 2008

(65) Prior Publication Data

US 2010/0288869 A1 Nov. 18, 2010

(51) Int. Cl.

| | |
|---|---|
| ***F42B 15/01*** | (2006.01) |
| ***F42B 10/66*** | (2006.01) |
| *F42B 15/00* | (2006.01) |
| *F42B 10/60* | (2006.01) |

(52) U.S. Cl. ..... 244/3.22; 244/3.1; 244/3.15; 244/3.21

(58) Field of Classification Search ..... 244/3.1–3.3
See application file for complete search history.

(56) References Cited

U.S. PATENT DOCUMENTS 2,958,282 A * 11/1960 Czajkowski et al. ..... 244/3.14
2,980,363 A * 4/1961 Schonstedt ..... 244/3.22
3,374,967 A * 3/1968 Plumley ..... 244/3.14
3,614,027 A * 10/1971 Lewis ..... 244/3.22
4,408,735 A * 10/1983 Metz ..... 244/3.22
5,054,712 A * 10/1991 Bar et al. ..... 244/3.22
5,074,492 A * 12/1991 Morgand ..... 244/3.22
5,123,611 A * 6/1992 Morgand ..... 244/3.22
6,695,251 B2 * 2/2004 Rodden et al. ..... 244/3.21
7,416,154 B2 * 8/2008 Bittle et al. ..... 244/3.22

* cited by examiner

*Primary Examiner*—Bernarr E Gregory
(74) *Attorney, Agent, or Firm*—Renner, Otto, Boisselle & Sklar, LLP

(57) ABSTRACT

Methods and apparatus for guiding a projectile according to various aspects of the present comprise a force source disposed on the projectile and a control system operably connected to the force source. The control system is configured to initially activate the force source when the force source is substantially in a selected rotational position, and subsequently activate the force source when the force source rotates to substantially the selected rotational position a second time.

25 Claims, 5 Drawing Sheets

METHODS AND APPARATUS FOR GUIDING A PROJECTILE

BACKGROUND OF THE INVENTION

Flight controls facilitate controlling a craft's flight attitude. Effective flight controls permit stable flight and guidance of the craft.

Many flight controls are used in different craft. For example, many conventional aircraft use elevators, ailerons, and a rudder to control the attitude of the craft. Others draw on vectored exhaust. Other craft employ lateral forces to deflect the attitude of the aircraft in a desired direction.

Flight controls may, however, may induce undesirable consequences. For example, activating the flight controls may induce oscillations in the body of the aircraft. The oscillations may negatively affect performance, such as disrupting guidance systems, inducing physical stresses, and disturbing flight characteristics.

SUMMARY OF THE INVENTION

Methods and apparatus for guiding a projectile according to various aspects of the present invention comprise an impulse force source disposed on the projectile and a control system operably connected to the force source. The control system is configured to initially activate the force source when the force source is substantially in a selected rotational position, and subsequently activate the force source when the force source rotates to substantially the selected rotational position a second time.

BRIEF DESCRIPTION OF THE DRAWING

A more complete understanding of the present invention may be derived by referring to the detailed description and claims when considered in connection with the following illustrative figures. In the following figures, like reference numbers may refer to similar elements and steps.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present specification and accompanying drawing show an exemplary embodiment by way of illustration and best mode. While these exemplary embodiments are described, other embodiments may be realized, and changes may be made without departing from the spirit and scope of the invention. The detailed description is presented for purposes of illustration only and not of limitation. For example, the steps recited in any of the methods or process descriptions may be executed in any suitable order and are not limited to the order presented. Further, conventional mechanical and electrical aspects and elements of the individual operating components of the systems may not be described in detail. The representations of the various components are intended to represent exemplary functional relationships, positional relationships, and/or physical couplings between the various elements. Many alternative or additional functional relationships, physical relationships, optical relationships, or physical connections may be present in a practical system.

The present invention is described partly in terms of functional components and various methods. Such functional components may be realized by any number of components configured to perform the specified functions and achieve the various results. For example, the present invention may employ various materials, control surfaces, propulsion systems, actuators, body shapes, control systems, sizes, and weights for various components, such as sensors, force sources, mechanical components, and the like, which may carry out a variety of functions. In addition, the present invention may be practiced in conjunction with any number of applications and environments, and the systems described are merely exemplary applications of the invention. Further, the present invention may employ any number of conventional techniques for manufacture, deployment, and the like.

Figure 1:
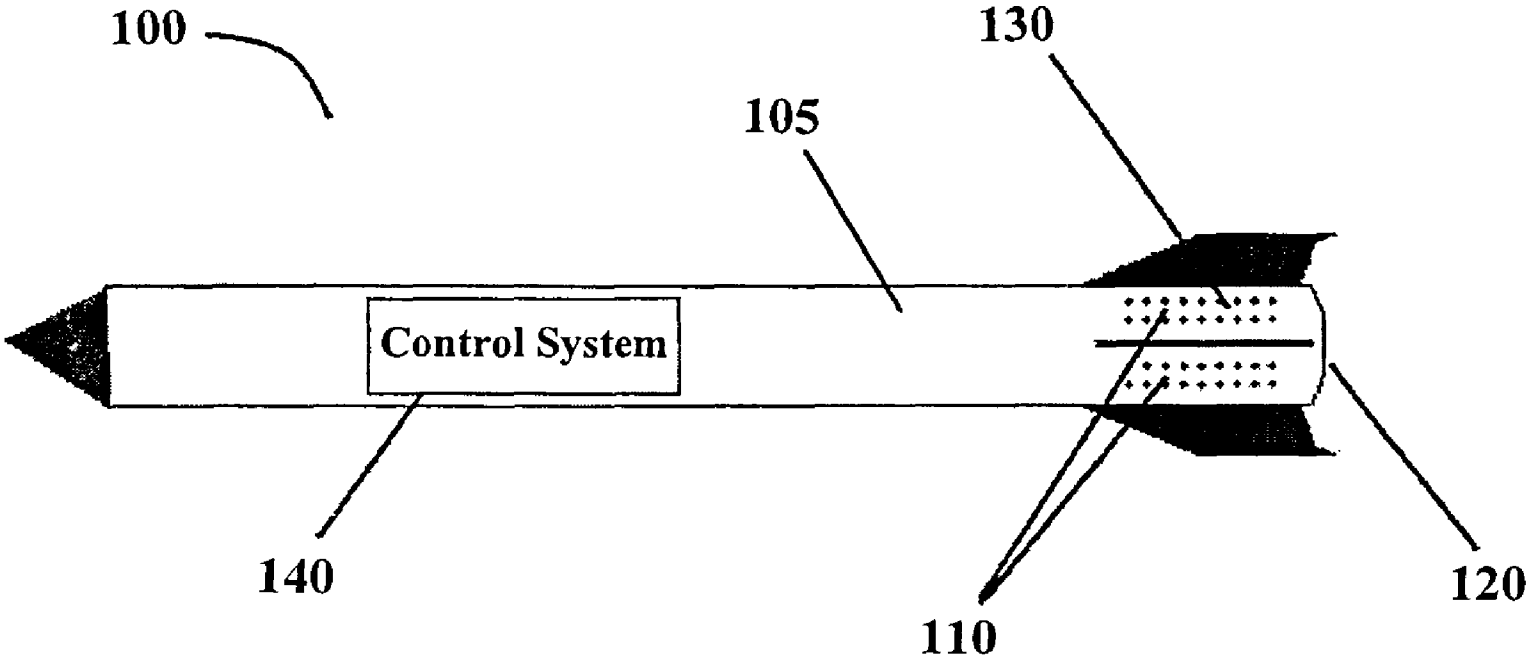
FIG. 1 representatively illustrates a missile in accordance with an exemplary embodiment of the present invention.
Figure 2:
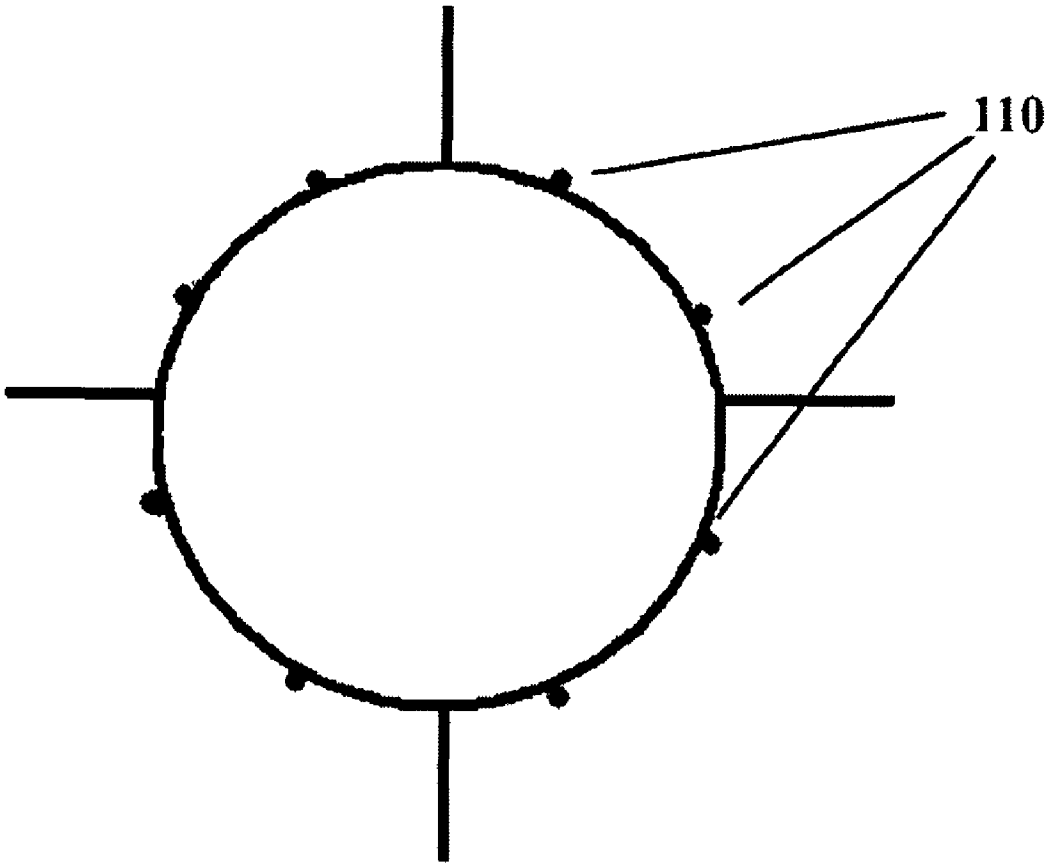
FIG. 2 representatively illustrates a rear view of a missile with a plurality of force sources.

Referring to FIG. 1, methods and apparatus for guiding a projectile 100 according to various aspects of the present invention operate in conjunction with a projectile 100. A guidance system 130 operating in conjunction with the projectile 100 is configured to selectively adjust the path of the projectile 100. A control system 140 controls the operation of the guidance system 130 to control the flight dynamics of the projectile 100, for example to arrive at a target. The flight dynamics include the position and orientation of the projectile 100. The orientation of the projectile 100 relates to the roll, pitch and yaw of the projectile 100.

The projectile 100 may comprise any moving system or object to be guided or oriented by the guidance system 130 and/or the control system 140. For example, the projectile 100 may comprise a munition, such as a missile or rocket, or a craft, such as a spacecraft. In the present embodiment, the projectile 100 comprises a missile, and the control system 140 and guidance system 130 direct the missile to a target.

The guidance system 130 selectively adjusts the orientation and/or position of the projectile 100. The guidance system 130 may comprise any system for changing the orientation and/or position of the projectile 100. For example, the guidance system 130 may include one or more conventional control surfaces, fins, canards, brakes, thrust vectoring elements, and/or other systems that may affect the position and/or orientation of the projectile 100. The projectile 100 may also include a propulsion system 120, such as a rocket motor, jet, and/or other propulsion system.

In the present embodiment, the projectile 100 may roll in flight, for example due to the orientation of the fins and/or rifling within a launch system. In addition, the present guidance system 130 includes one or more force sources 110 that exert force on the projectile 100. For example, the force sources 110 may comprise lateral impulse jets fixed on the exterior of a body 105 of the projectile 100, such as near the tail end or fore end of the projectile 100. When fired, the lateral impulse jets exert an impulsive force upon the missile, causing an opposing movement of the missile in reaction to the force exerted by the jet. The force sources 110 may be disposed fully or partially around the exterior of the missile.

Figure 3C:
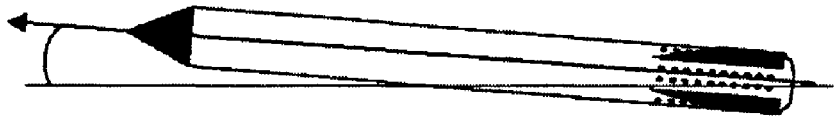
FIGS. 3A-C representatively illustrate an effective change in attitude of a missile following the activation of at least one of the force sources.
Figure 3B:
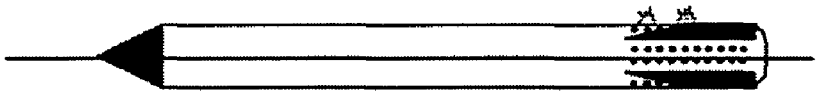
Figure 3A:
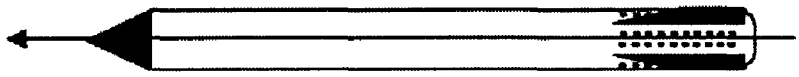

More particularly, in the present embodiment, the present force sources 110 comprise an array of one-shot pulse jets, each of which may be fired one time only. The pulse jets are fixed to the exterior of the missile near the tail end of the missile. Referring now to FIGS. 3A-C, to adjust the orientation of the missile, one or more of the force sources 110 may be fired on one side of the missile to turn the missile in that direction. The magnitude of the flight adjustment may be controlled by adjusting the pulse force exerted by the force sources 110, such as by controlling the firing duration and/or firing power of the force source 110. Further, in the present configuration in which the missile rolls in flight, a selected number force sources 110 may be fired when rotated to an appropriate angular position to cause the desired magnitude and directional change in the missile's flight.

Figure 4:
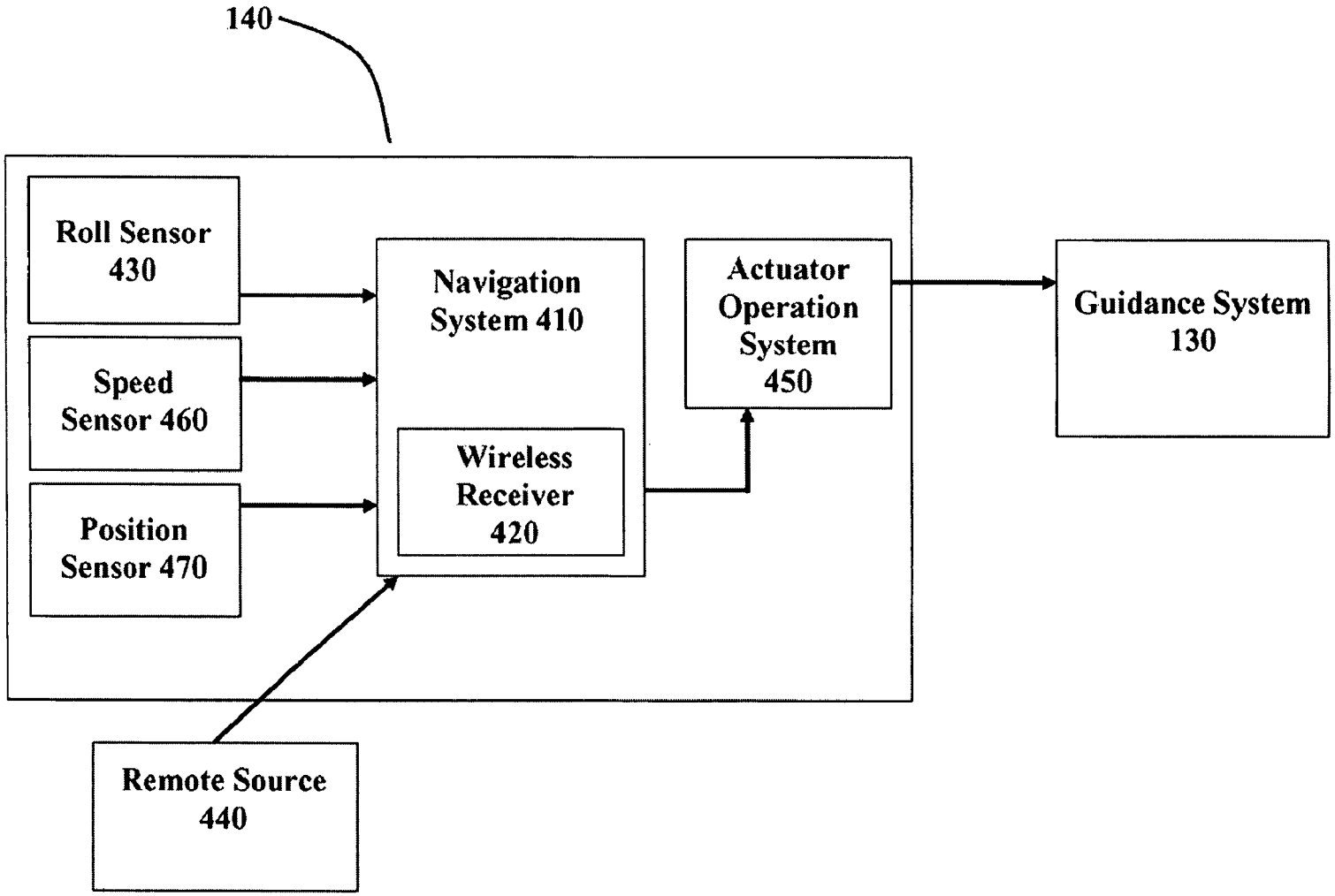
FIG. 4 representatively illustrates a block diagram of the control system, navigation system, and operation system.

The control system 140 controls the guidance system 130 to adjust the projectile's 100 orientation and/or position. The control system 140 may comprise any system for controlling the guidance system 130 to guide the projectile 100. For example, referring to FIG. 4, the control system 140 may comprise a navigation system 410 to determine a desired course and/or an actuator operation system 450 to control the guidance system 130 to achieve the course determined by the navigation system 410.

In the present embodiment, the control system 140 is configured to initially activate one or more force sources 110 when the force sources 110 are in a rotational position with respect to the central axis of the missile to effect a desired course change. The control system 140 may be further configured to subsequently activate the force source 110 again when the force source 110 rotates to substantially the selected rotational position a second time. The second activation of the force source 110 tends to counter oscillations induced by the first activation of the force source 110. For example, the control system 140 may activate the force source 110 the second time about halfway through an oscillation cycle to destructively interfere with the oscillation. The control system 140 may measure undesired flight characteristics, counter the undesired flight characteristics, and control the projectile's 100 flight dynamics.

More particularly, the navigation system 410 determines a desired lateral velocity change for the projectile 100. The navigation system may comprise any system for determining a course change for the projectile 100, such as an inertial guidance system, a global positioning system receiver, a wireless receiver receiving signals from a remote source, a set of flight instructions stored in a memory, a laser-, heat-, or radar-homing seeker, or other system for determining a desired course change for the projectile 100.

In the present embodiment, the navigation system includes a wireless receiver 420 configured to receive navigation signals from a remote source 440, such as a ground-, aircraft-, or ship-based control station. For example, the remote source 440 may compare a desired trajectory to arrive at the target to the missile position. The remote source 440 may transmit a navigation signal to the navigation system 410 to adjust the path of the projectile 100 accordingly. The navigation signal may comprise any suitable signals providing any relevant information for confirming or correcting the flight dynamics. In one embodiment, the remote source 440 provides timing and location signals for activating the force sources 110. The timing and location signals may indicate the desired angular position for firing the force sources 110 and/or which forces sources 110 to fire at a particular time. Alternatively, the navigation system 410 may provide signals corresponding to a desired course or course change, position or position change, orientation or orientation change, or the like.

The actuator operation system 450 operates the guidance system 130 according to the desired flight dynamics determined by the navigation system 410. The actuator operation system 450 may include any appropriate system for controlling the guidance system 130 to achieve the position and/or orientation according to the desired flight dynamics determined by the navigation system. For example, the actuator operation system 450 may be operably connected, directly or indirectly, to the force sources 110 such that the actuator operation system 450 may selectively activate the force sources 110 to adjust the projectile's 100 path and or orientation.

In the present embodiment, the actuator operation system 150 is configured to determine a force required to change the attitude of the projectile 100 to achieve the desired path correction. The actuator operation system 150 may determine the required force according to any relevant criteria and/or algorithm, such as according to the speed of the missile and the magnitude of the desired velocity change. The actuator operation system 150 may further control the initial activation and the subsequent activation of the force sources 110 such that each activation of the force sources 110 generates about half of the required force; the remaining half is provided by the second activation of the force sources 110. In addition, the actuator operation system 150 may select which force sources 110 to activate, such as according to the availability of the various force sources 110, the angular location of the force sources 110, and/or the magnitude of force required to generate the selected flight path alteration of the projectile 100.

The control system 140 may further comprise additional systems for the navigation and control of the missile. For example, the control system 140 may comprise one or more sensors to determine the status of the projectile 100, such as a speed sensor, an angular position sensor, a roll rate sensor, and/or an oscillation sensor. For example, the control system 140 may include a roll sensor 430 for determining the angular position of the projectile 100 body and/or force sources 110. The roll sensor 430 may generate a signal corresponding to the rotational position of the projectile 100 body, such as to facilitate activating the appropriate force sources 110 at the proper time to generate the desired change in missile orientation and/or counter oscillations.

The sensors may be located on and within the projectile 100 and/or remotely located, and may provide information to the navigation system 410 and/or actuator operation system 450. In one embodiment, the sensor comprises one or more optical markers on the projectile 100, such as on the fins. An external system, such as the remote source, may monitor the position of the optical markers to determine the angular position of the projectile 100.

In operation, the projectile 100 is launched. The navigation system 410 may compare the course, position, trajectory, or other flight dynamics information to a desired course, position, trajectory, or other flight dynamics to establish a desired correction. For example, the control system 140 may receive information from the sensors to determine the current position, speed, attitude, and/or other information relating to the missile. Further, various aspects of the missile and its course may be predetermined. For example, the control system 140 may access a memory to determine or estimate initial projectile 100 speed, elevation angle, heading, spin rate, and the like may be known values at time of launch. Alternatively, the projectile's 100 speed and flight dynamics may be measured from ground-based or onboard sensing equipment.

The desired course correction is used by the guidance system 130 to adjust the flight dynamics of the missile. In the present embodiment, the actuator operation system 450 determines the amount of force required to generate the desired correction and the angle of correction required to achieve the desired correction. The actuator operation system 450 may then select which force sources 110 to activate to achieve the desired force and change of orientation.

In the present embodiment, the actuator operation system 450 may select a number of pulse jets for activation to achieve the desired force. For example, if the desired force is 20 pounds and each pulse jet generates five pounds of lateral thrust, the actuator operation system 450 make fire a total of four jets to achieve the desired force. In addition, if the desired change of orientation requires the missile to incline the fore end upwards, the actuator operation system 450 may select to fire pulse jets as they rotate to the top of the missile. Further, the actuator operation system 450 may select pulse jets according to their availability. For example, if certain pulse jets have already been fired, the actuator operation system 450 may remove the spent pulse jets from the candidate pulse jets to be fired and instead select pulse jets that have not yet been activated.

Figure 5A:
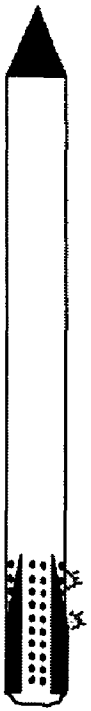
FIGS. 5A-D representatively illustrate oscillations that are created when a first force source is activated and the reduction or cancellation of the oscillation due to a second force source that is activated.
Figure 5B:
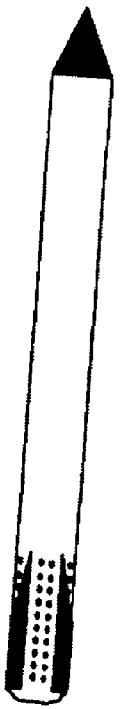

The actuator operation system 450 may activate one or more force sources 110 to effect the desired change in flight dynamics. In the present embodiment, the actuator operation system 450 fires the selected pulse jets in two stages. In the first stage, referring to FIG. 5A, the actuator operation system 450 fires half of the selected pulse jets, corresponding to half the force required to change the flight dynamics of the missile as desired, at a time when the pulse jets are in the proper roll position to make the desired change in the flight dynamics. Firing of the first stage of pulse jets induces a partial lateral velocity adjustment, as well as an oscillation in the missile body (FIG. 5B).

Figure 5C:
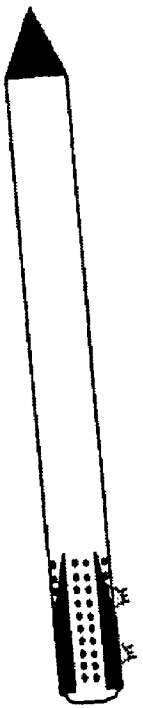

The actuator operation system 450 may then fire the second stage of pulse jets to complete the change to the lateral velocity and cancel the induced oscillation (FIG. 5C). In one embodiment, the actuator operation system 450 delays firing the second stage until mid-cycle of the oscillation and the second stage of pulse jets is in substantially the same rotational position as the first stage. The actuator operation system 450 may measure the missile's new vector and flight dynamics, for example in conjunction with the sensors, or may delay a selected time period based on known factors, such as a known roll rate, speed, and/or oscillation frequency.

Figure 5D:
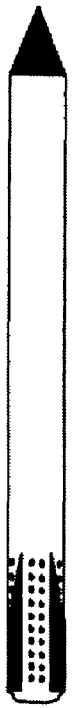

During the mid-cycle of an oscillation, the second stage of pulse jets may be fired to complete the lateral velocity adjustment and dampen or cancel the induced oscillations. To complete the flight dynamics adjustment and dampen the oscillations, the second stage of pulse jets may be activated at substantially the same rotational position as the first stage. Upon firing the second stage, the full force required to effect the flight dynamics adjustment has been applied at substantially the correct roll angle. In addition, the oscillation induced by the first stage is substantially canceled by activation of the second stage at the same rotational location and at mid-cycle of the oscillation (FIG. 5D).

in the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles or the same.

The invention claimed is:

1. A missile, comprising:

a body that is configured to roll while the missile is in flight;

a force source operably connected to the body to exert an impulsive force on the missile when activated, causing an opposing movement of the missile in reaction; and a control system operably connected to the force source, wherein the control system is configured to:

initially activate the force source when the force source is substantially in a selected rotational position; and subsequently activate the force source when the force source rotates to substantially the selected rotational position a second time.

2. A missile according to claim 1, wherein initially activating the force source generates an oscillation in the body, and the control system is configured to subsequently activate the force source about halfway through an oscillation cycle of the oscillation.

3. A missile according to claim 1, wherein the force source comprises a plurality of pulse jets.

4. A missile according to claim 1, wherein the control system includes a roll sensor responsive to the rotational position of the body and configured to generate a signal corresponding to the rotational position of the body.

5. A missile according to claim 4, wherein the roll sensor comprises an optical marker configured to be observed by a remote optical sensor.

6. A missile according to claim 1, wherein:

the control system is configured to determine a force required to change the attitude of the projectile; and each of the initial activation and the subsequent activation of the force source is configured to generate about half of the required force.

7. A missile according to claim 6, wherein the control system is configured to determine the required force according to a speed and a magnitude of the desired attitude change of the projectile.

8. A missile according to claim 1, wherein the control system includes a receiver configured to receive navigational signals from a remote source; and the control system is configured to activate the force source according to the received navigational signals.

9. A missile according to claim 8, wherein the navigational signals comprise timing and location signals for activating the force source.

10. A missile according to claim 1, wherein the control system activates the force source according to:

an availability of one or more elements of the force source;

a rotational location of one Of more elements of the force source; and a required magnitude of force required to generate a selected flight path alteration of the missile.

11. A control and guidance system for affecting the flight path of a missile, comprising:

a first plurality of pulse jets;

a second plurality of pulse jets; and an actuator system, operably connected to the first plurality of pulse jets and the second plurality of pulse jets, the actuator system configured to activate:

a first set of pulse jets in the first plurality of pulse jets corresponding to about one-half of a force required for a desired flight path adjustment when the first set of pulse jets is substantially in a selected rotational position; and a second set of pulse jets in the second plurality of pulse jets corresponding to about one-half of the force required for the desired flight path adjustment when the second set of pulse jets is substantially in the selected rotational position.

12. A control and guidance system according to claim 11, wherein the control and guidance system further comprises a roll sensor responsive to the rotational position of the projectile, and wherein the actuator system is configured to activate the first and second set of pulse jets according to signals received from the roll sensor.

13. A control and guidance system according to claim 12, wherein the roll sensor comprises an optical marker configured to be observed by a remote optical sensor.

14. A control and guidance system according to claim 11, wherein:

activating the first set of pulse jets generates an oscillation in the missile; and the control and guidance system is configured to activate the second set of pulse jets about halfway through a cycle of the oscillation.

15. A control and guidance system according to claim 11, wherein the control and guidance system is configured to determine force required for the desired flight path adjustment according to a speed and a magnitude of the desired attitude change of the projectile.

16. A control and guidance system according to claim 11, further comprising a receiver configured to:

receive navigational signals from a remote source; and activate the first and second sets of pulse jets according to the received navigational signals.

17. A control and guidance system according to claim 16, wherein the navigational signals comprise timing and location signals for activating the first and second sets of pulse jets.

18. A control and guidance system according to claim 11, wherein the control and guidance system activates the first and second sets of pulse jets according to availabilities of the first and second sets of pulse jets.

19. A method of controlling a flight path of a missile, comprising:

determining a required force for achieving a desired attitude change of the missile;

activating a first force source of the missile that exerts an impulsive force on the missile when activated, to causing an opposing movement of the missile in reaction, with about half of the required force when the missile is in a first roll position aligning the first force source for the desired attitude change; and after activating the first force source, then when the missile is in a second roll position, activating a second aligned force source of the missile that exerts an impulsive force on the missile when activated, to causing an opposing movement of the missile in reaction, to complete the desired attitude change with about half of the required force.

20. A method of controlling a flight path of a missile according to claim 19, wherein:

activating the first force source comprises generating an oscillation in a body of the missile; and activating the second force source comprises activating the second force source about halfway through a cycle of the oscillation.

21. A method of controlling a flight path of a missile according to claim 19, further comprising generating a roll signal corresponding to the rotational position of the missile, and wherein activating the first and second force sources includes activating the first and second force sources according to the roll signal.

22. A method of controlling a flight path of a missile according to claim 21, wherein generating the roll signal comprises remotely monitoring an optical marker on the missile.

23. A method of controlling a flight path of a missile according to claim 19, wherein determining the required force includes determining a speed of the missile and a magnitude of the desired attitude change of the missile.

24. A method of controlling a flight path of a missile according to claim 19, wherein determining the required force includes receiving navigational signals from a remote source; and activating the first and second force sources includes activating the first and second force sources according to the received navigational signals.

25. A method of controlling a flight path of a missile according to claim 24, wherein the navigational signals comprise timing and location signals for activating the first and second force sources.

* * * * *